US008160783B2

(12) United States Patent
Shull

(10) Patent No.: US 8,160,783 B2
(45) Date of Patent: Apr. 17, 2012

(54) DIGGING CONTROL SYSTEM

(75) Inventor: Andrew Gordon Shull, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 954 days.

(21) Appl. No.: 12/216,119

(22) Filed: Jun. 30, 2008

(65) Prior Publication Data

US 2009/0326768 A1 Dec. 31, 2009

(51) Int. Cl.

| | |
|---|---|
| ***A01B 79/00*** | (2006.01) |
| ***E02F 3/04*** | (2006.01) |
| ***E02F 3/165*** | (2006.01) |
| ***G06F 7/70*** | (2006.01) |

(52) U.S. Cl. ..... 701/50; 701/124; 172/1; 37/414; 37/419; 37/907

(58) Field of Classification Search ..... 701/50, 701/124; 91/304, 427, 459, 461; 60/426–429, 60/461; 37/411, 414, 419, 421, 440, 443, 37/444, 446–449, 467, 907; 172/1–3, 439, 172/449, 468

See application file for complete search history.

(56) References Cited

U.S. PATENT DOCUMENTS

| | | | | |
|---|---|---|---|---|
| 4,919,222 | A | 4/1990 | Kyrtsos et al. | |
| 5,116,186 | A | 5/1992 | Hanamoto et al. | |
| 5,320,025 | A * | 6/1994 | Ikari | 91/459 |
| 5,941,921 | A | 8/1999 | Dasys et al. | |
| 5,968,103 | A | 10/1999 | Rocke | |
| 6,205,687 | B1 | 3/2001 | Rocke | |
| 6,385,519 | B2 | 5/2002 | Rocke | |
| 6,502,498 | B2 | 1/2003 | Shull et al. | |
| 6,879,899 | B2 | 4/2005 | Budde | |
| 7,076,354 | B2 | 7/2006 | Ikari | |
| 2002/0152885 | A1 | 10/2002 | Shull et al. | |
| 2006/0245896 | A1 | 11/2006 | Alshaer et al. | |
| 2007/0166168 | A1 | 7/2007 | Vigholm et al. | |
| 2007/0260380 | A1 | 11/2007 | Mintah et al. | |

* cited by examiner

*Primary Examiner* — Christopher J. Novosad
(74) *Attorney, Agent, or Firm* — Finnegan, Henderson, Farabow, Garrett & Dunner LLP

(57) ABSTRACT

A digging control system for use with a machine having a work implement is disclosed. The digging control system may have a sensing system configured to generate a signal indicative of a loading of the work implement. The digging control system may also have a controller. The controller may be configured to determine the loading of the work implement based on the signal. Additionally, the controller may be configured to initiate tilting of the work implement in response to a determination that the loading of the work implement exceeds a threshold loading. The work implement may not be substantially lifted during this tilting of the work implement. The controller may also be configured to monitor a tilt angle of the work implement. Additionally, the controller may be configured to cease tilting of the work implement when the tilt angle of the work implement substantially equals a threshold tilt angle.

20 Claims, 5 Drawing Sheets

DIGGING CONTROL SYSTEM

TECHNICAL FIELD

The present disclosure relates generally to a control system and, more particularly, to digging control system for use with a machine having a work implement.

BACKGROUND

In general, earthmoving machines such as wheel loaders, excavators, track-type loaders, and the like are used for moving mass quantities of material. These earthmoving machines have work implements that can include a bucket. The bucket is controllably actuated by at least one hydraulic cylinder. An operator typically performs a sequence of distinct operations to capture, lift and dump material (i.e., to dig material) with the bucket by way of the hydraulic cylinder(s).

A typical sequence can include the operator first positioning the bucket near the ground surface and close to a pile of material. The operator then directs the machine forward to engage the pile of material. Next, the operator lifts the bucket to generate a downward force on the machine that maintains traction, and then racks (tilts) the bucket back to capture the material. The operator then moves the earthmoving machine to a desired dump location, and dumps the captured material from the bucket. Next, the operator moves the earthmoving machine back to the pile of material and repeats the sequence.

The performance of the typical sequence may be inefficient under certain circumstances because the machine may waste energy and time needlessly pushing the material into the pile rather than pushing the material upward out of the pile. Specifically, the material may be needlessly pushed into the pile when the operator directs the machine forward and when the operator lifts the bucket. Wasting energy may increase fuel consumption of the machine, thereby increasing the operating costs of the machine. Moreover, wasting time may reduce the number of sequence repetitions completed during a given time period. Thus, the machine may fail to maximize an amount of material moved during the given time period.

One way to increase the efficiency of an earthmoving machine may be to alter the typical sequence. An example of this strategy is described in U.S. Pat. No. 6,385,519 (the '519 patent) issued to Rocke on May 7, 2002. The '519 patent describes driving a machine, such as a loader, with a bottom of a bucket nearly level and close to the ground, toward a pile of material. After a tip of the bucket contacts and begins digging into the pile of material, an electronic controller generates command signals to simultaneously lift and rack the bucket through the pile of material while the loader continues to be driven forward. This lifting and racking of the bucket maximizes a traction of the loader and allows the bucket to cut upward while letting material slide to a back portion of the bucket. The sequence relieves drivetrain torque by racking the bucket, thereby reducing a resistance of the pile of material. Reducing the resistance of the pile of material reduces drivetrain stalls and wheel slippage.

Although the strategy of the '519 patent may help reduce the resistance of the pile of material by simultaneously lifting and racking the bucket, the strategy may be difficult to implement without the electronic controller of the '519 patent. Specifically, it may be difficult for an operator to simultaneously lift and rack the bucket while driving toward the pile. It may be especially difficult for the operator to simultaneously lift and rack the bucket while driving toward the pile if the bucket is attached to the loader by a torque parallel linkage. Moreover, though the sequence of the '519 patent may help reduce the resistance of the pile as the bucket is first lifted, the sequence of the '519 patent may do little to reduce the resistance of the pile before the bucket is first lifted. This is because the bottom of the bucket of the '519 patent may not be racked until the bucket is first lifted. Thus, energy may be wasted needlessly pushing the material into the pile before and/or while the bucket is first lifted.

The disclosed system and method are directed to overcoming one or more of the problems set forth above and/or other problems in the art.

SUMMARY

In one aspect, the present disclosure may be directed to a digging control system for use with a machine including a work implement. The digging control system may include a sensing system associated with the machine and configured to generate a signal indicative of a loading of the work implement. The digging control system may also include a controller in communication with the sensing system and the work implement. The controller may be configured to determine the loading of the work implement based on the signal. Additionally, the controller may be configured to initiate tilting of the work implement in response to a determination that the loading of the work implement exceeds a threshold loading. The work implement may not be substantially lifted during this tilting of the work implement. The controller may also be configured to monitor a tilt angle of the work implement. Additionally, the controller may be configured to cease tilting of the work implement when the tilt angle of the work implement substantially equals a threshold tilt angle.

In another aspect, the present disclosure may be directed to a method of digging with a work implement of a machine. The method may include monitoring a loading of the work implement. Additionally, the method may include tilting the work implement without substantially lifting the work implement when the loading of the work implement exceeds a threshold loading. The method may also include monitoring a tilt angle of the work implement. Additionally, the method may include ceasing tilting of the work implement when the tilt angle of the work implement substantially equals a threshold tilt angle.

DETAILED DESCRIPTION

Figure 1:
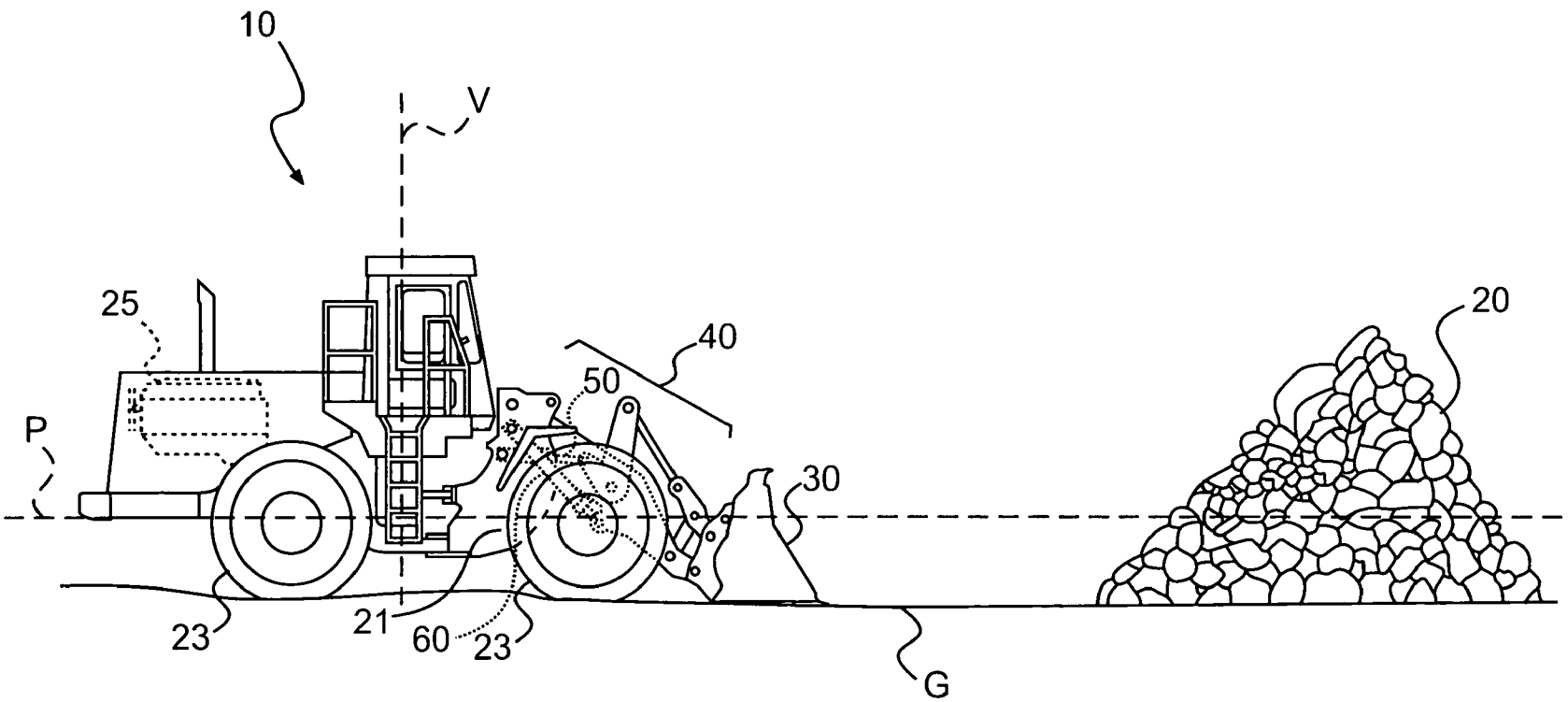
FIG. 1 is a pictorial illustration of an exemplary disclosed machine having an exemplary disclosed work implement.

FIG. 1 illustrates an exemplary machine 10 moving toward a pile of material 20. Machine 10 may be a mobile machine that may be used to move pile of material 20. For example, machine 10 may be a wheel loader, a track loader, a backhoe loader, an excavator, a front shovel, or another earthmoving machine known in the art. Pile of material 20 (hereafter "pile 20") may include sand, stone, gravel, or another form of material moveable by machine 10.

As illustrated in FIG. 1, machine 10 may include a frame 21 connected to traction devices 23, which may be driven by a power source 25 to move machine 10. This movement may be in a direction parallel to a longitudinal plane P of machine 10. As used herein, longitudinal plane P may include a plane orthogonal to a vertical axis V of machine 10. Vertical axis V may be substantially orthogonal to a ground surface G when ground surface G is substantially flat. Traction devices 23 may include, for example, wheels, tracks, or other types of traction devices known in the art. Power source 25 may include, for example, a combustion engine, an electric motor, or another type of power source known in the art.

Machine 10 may move pile 20 with a work implement 30. Work implement 30 may be a bucket operatively connected to machine 10 via a linkage 40. Alternatively, work implement 30 may be a container, a vessel, or another work implement known in the art. Although linkage 40 is illustrated as a torque parallel linkage, it should be understood that linkage 40 may be another type of linkage known in the art such as, for example, a z-bar linkage. Linkage 40 may include a tilt actuator 50 and a lift actuator 60, each of which may include a hydraulic cylinder actuator or another type of actuator known in the art. Tilt actuator 50 may be actuated to tilt work implement 30, while lift actuator 60 may be actuated to lift work implement 30. An operator of machine 10 may control the actuations of tilt actuator 50 and/or lift actuator 60 via levers (not shown). If linkage 40 is a torque parallel linkage, the operator may separately and independently control tilting and lifting of work implement 30. In other words, the operator may not control tilt actuator 50 to lift work implement 30. Additionally, the operator may not control lift actuator 60 to tilt work implement 30. It should be noted, however, that for some configurations of linkage 40 (non-torque parallel configurations), the operator may control tilt actuator 50 to lift work implement 30. For these configurations, the operator may also control lift actuator 60 to tilt work implement 30. Alternatively, machine 10 may include a digging control system 70, illustrated in FIG. 2, for controlling the tilting and/or lifting of work implement 30.

Figure 2:
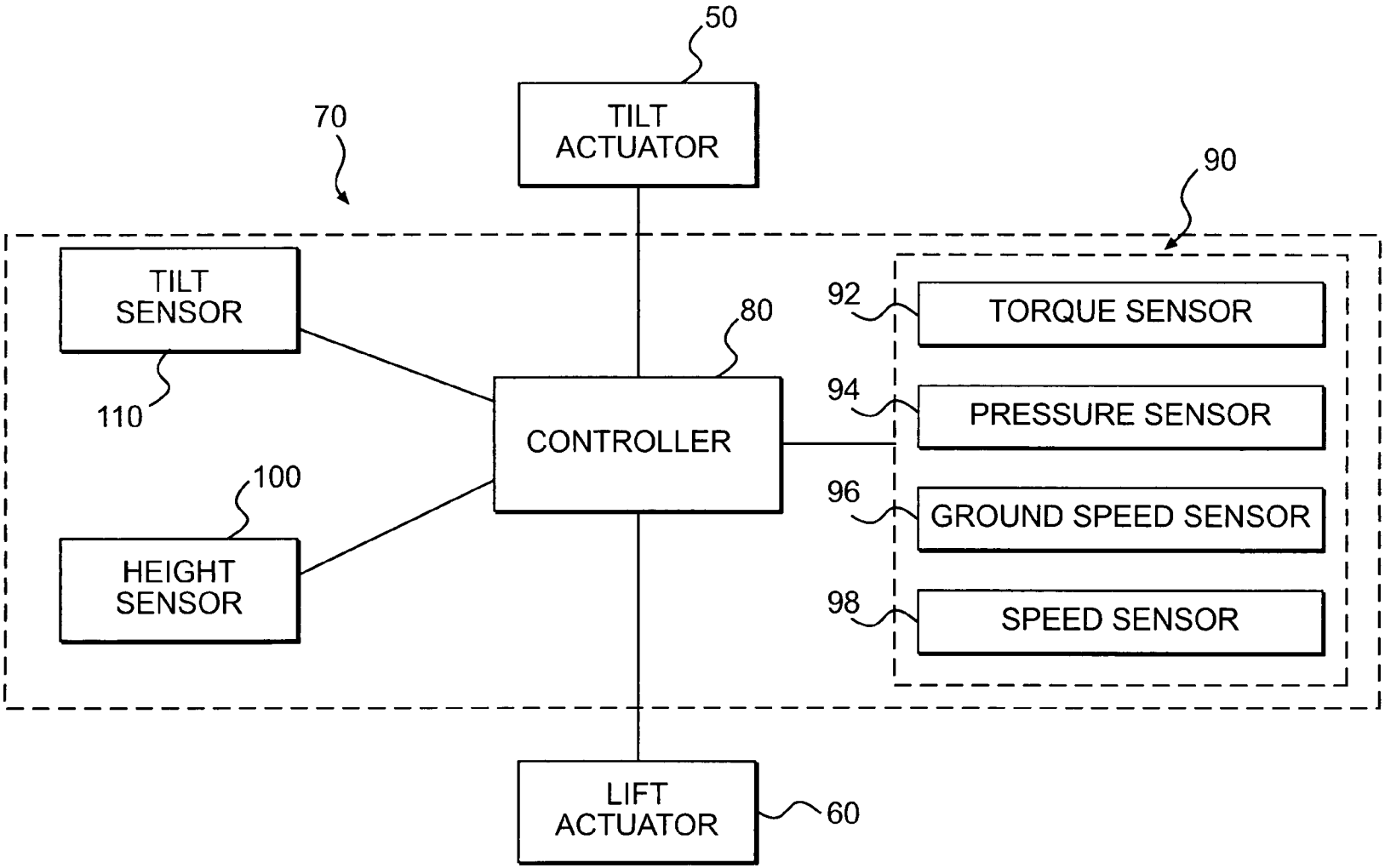
FIG. 2 is a diagrammatic illustration of an exemplary disclosed digging control system for use with the machine of FIG. 1.

As illustrated in FIG. 2, digging control system 70 may have a controller 80, which may include one or more processors (not shown) and one or more memory devices (not shown). Controller 80 may communicate with sensors of a sensing system 90 to monitor loading of work implement 30. This loading may correspond to a resistive force of pile 20 to movement (horizontal and/or vertical) by work implement 30, and may be indicated by various parameters. It is contemplated that sensing system 90 may include sensors configured to sense each of these various parameters. For example, the sensors of sensing system 90 may include a torque sensor 92 to sense a power source torque; a pressure sensor 94 to sense a pressure within tilt actuator 50 and/or lift actuator 60; a ground speed sensor 96 to sense a ground speed of machine 10; and/or a speed sensor 98 to sense a power source speed. Additionally, controller 80 may communicate with a height sensor 100 to monitor a height of work implement 30. Controller 80 may also communicate with a tilt sensor 10 to monitor a tilt angle of work implement 30. Based on the communications with the sensors of sensing system 90, height sensor 100, and/or tilt sensor 110, controller 80 may communicate with tilt actuator 50 and/or lift actuator 60 to initiate and/or inhibit tilting and/or lifting of work implement 30.

Figure 3:
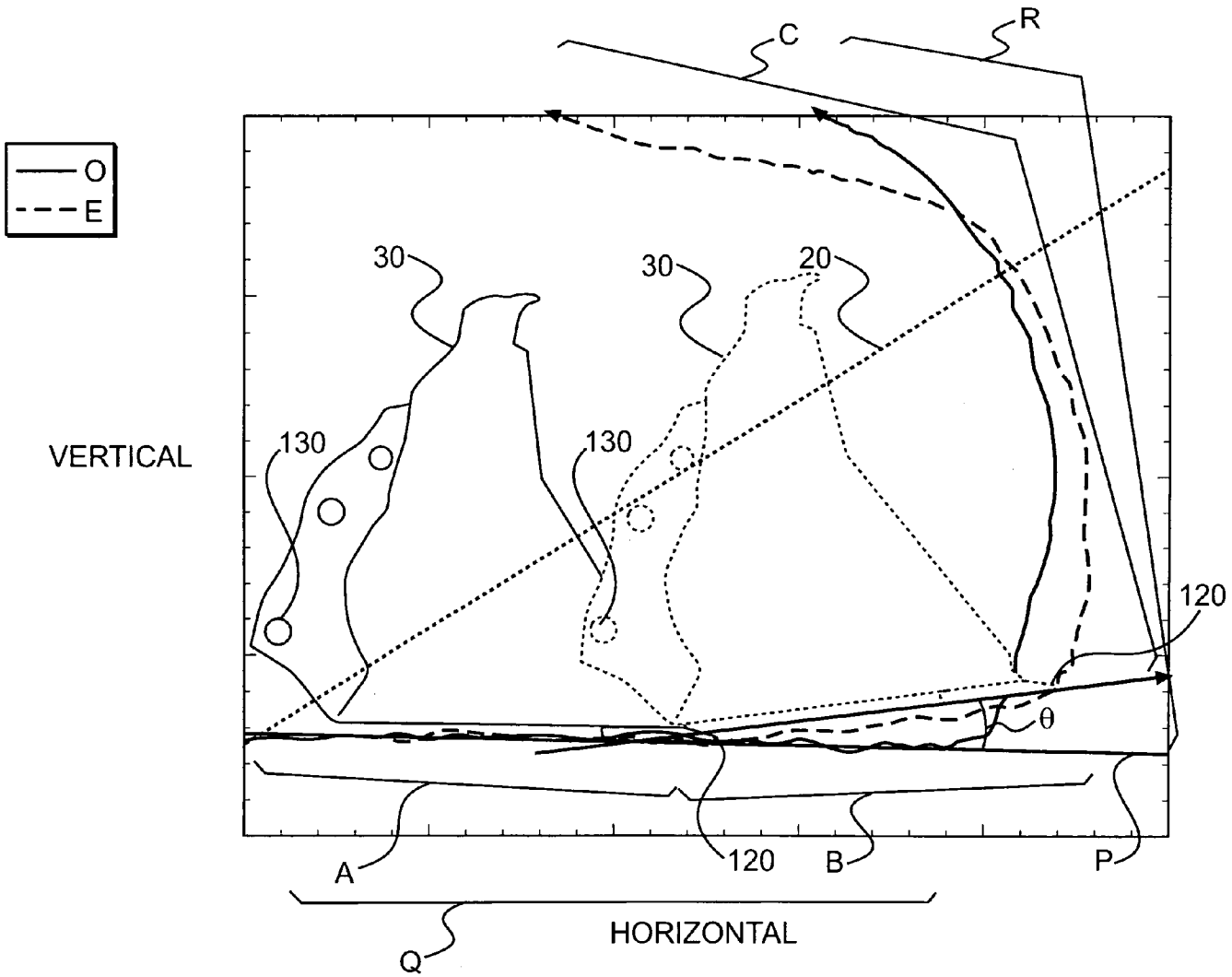
FIG. 3 is a graphical illustration of exemplary disclosed movements of the work implement of FIG. 1.

As illustrated in FIG. 3, this initiating and/or inhibiting of the tilting and/or lifting of work implement 30 may cause a tip 120 of work implement 30 to move along a path E (illustrated as a dashed line in FIG. 3). Path E represents a sequence for initiating and/or inhibiting tilting and/or lifting of work implement 30 based on the communications with the sensors of sensing system 90, height sensor 100, and/or tilt sensor 110. Specifically, machine 10 may be directed forward (rightward in FIG. 3) to engage pile 20, causing tip 120 to move along a portion A of path E. Neither the height nor the angle, which may be substantially 0 degrees, of work implement 30 may change as tip 120 moves along portion A. When work implement 30 engages pile 20 (i.e., when pile 20 sufficiently resists movement of work implement 30), work implement 30 may be tilted to a threshold angle θ, causing tip 120 to move along a portion B of path E. In FIG. 3, work implement 30 is illustrated with solid lines when it engages pile 20 and with dashed lines when it is tilted to threshold angle θ. Although tip 120 may rise as it moves along portion B, work implement 30 may not be substantially lifted during the tilting of work implement 30 to threshold angle θ. Specifically, a pivot axis 130, which may be positioned where work implement 30 connects to linkage 40 for lifting movement, may not be substantially lifted during the tilting of work implement 30. The rising of tip 120 may be caused solely by the tilting of work implement 30 and/or the resistance of pile 20 to movement of work implement 30. Threshold tilt angle θ may be less than a maximum tilt angle of work implement 30. For example, threshold tilt angle θ may be between substantially 10-20 degrees. Threshold tilt angle θ may vary based on the material included by pile 20. For example, threshold tilt angle θ may be between substantially 10-15 degrees when pile 20 includes gravel. When work implement 30 reaches threshold tilt angle θ, the tilting of work implement 30 may be ceased. Machine 10 may then be directed rearward while work implement 30 is lifted and/or tilted out of pile 20, causing tip 120 to move along a portion C of path E.

FIG. 3 also illustrates, for comparative purposes, movement of tip 120 along a path O (illustrated as a solid line in FIG. 3). Path O represents the typical sequence for initiating and/or inhibiting tilting and/or lifting of work implement 30. Specifically, machine 10 is directed forward to engage pile 20, causing tip 120 to move along a portion Q of path O. Neither the height nor the angle, which may be substantially 0 degrees, of work implement 30 changes as tip 120 moves along portion Q. When work implement 30 engages pile 20, work implement 30 is not tilted. Instead, work implement 30 remains angled at substantially 0 degrees. Machine 10 is then directed rearward while work implement 30 is lifted and/or tilted out of pile 20, causing tip 120 to move along a portion R of path O.

Figure 4:
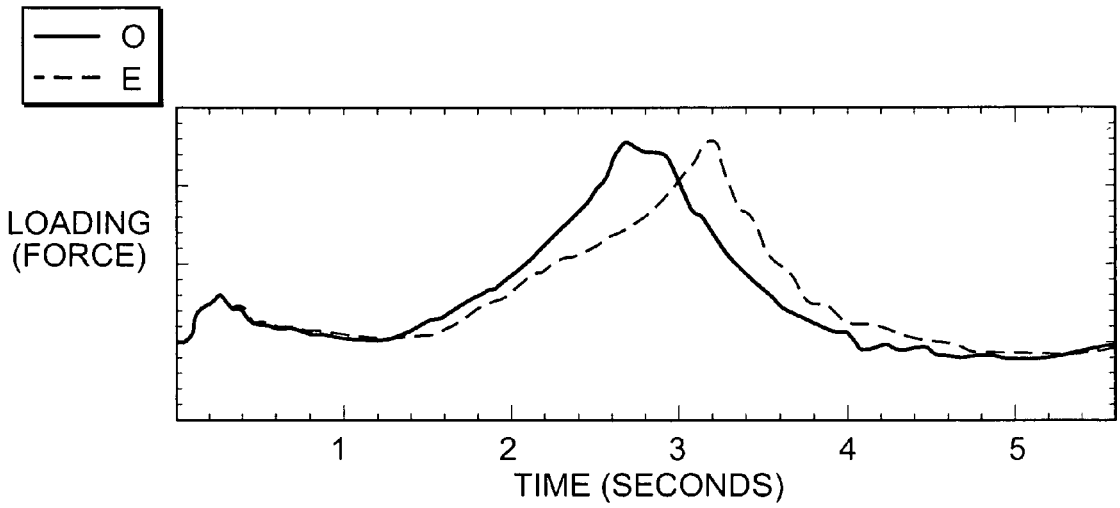
FIG. 4 is a graphical illustration of an exemplary disclosed horizontal loading of the work implement of FIG. 1 during the movements of FIG. 3.
Figure 5:
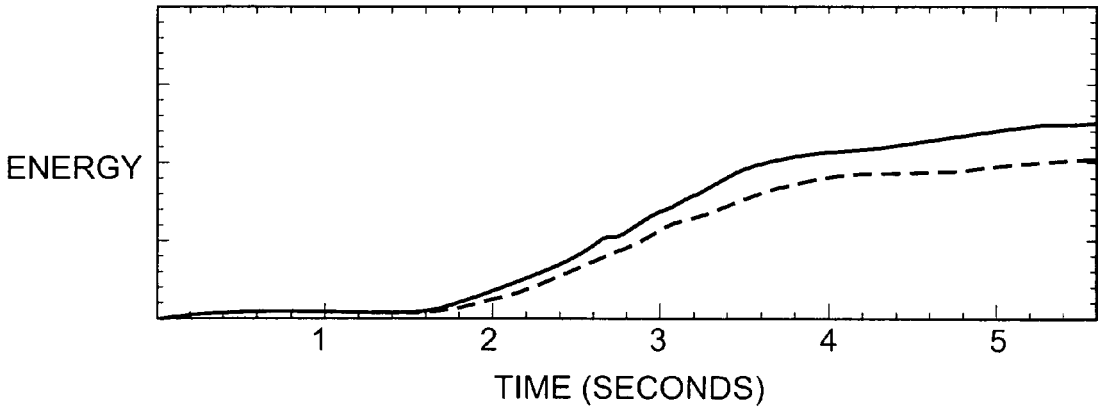
FIG. 5 is a graphical illustration of an exemplary disclosed energy expended by the machine of FIG. 1 during the movements of FIG. 3.

FIGS. 4 and 5 illustrate exemplary horizontal loadings of work implement 30 connected to machine 10 via a torque parallel linkage 40 (hereafter "horizontal loadings") and exemplary energies expended by machine 10 (hereafter "energies expended") during the sequences represented by paths E and O. Specifically, FIGS. 4 and 5 illustrate that these horizontal loadings and energies expended may be substantially equivalent between approximately 0-1.5 seconds, when machine 10 moves forward to engage pile 20. However, the horizontal loadings and energies expended may differ after approximately 1.5 seconds, when the sequence represented by path E (hereafter the "path E sequence") begins differing from the sequence represented by path O (hereafter the "path O sequence"). It should be understood that the horizontal loadings and energies expended, as illustrated in FIGS. 4 and 5, may vary based on the size of machine 10.

The horizontal loading during the path O sequence (hereafter the "path O sequence loading") may rise as machine 10 continues moving forward (between approximately 1.5-2.6 seconds). This loading may then peak at approximately 2.6 seconds when machine 10 ceases moving forward. The loading may then fall as machine 10 moves rearward while work implement 30 is lifted and/or tilted out of pile 20 (between approximately 2.6-5.6 seconds).

The horizontal loading during the path E sequence (hereafter the "path E sequence loading") may also rise as machine 10 continues moving forward (between approximately 1.5-3.2 seconds), but it may rise more slowly than the path O sequence loading between approximately 1.5-2.6 seconds. This is because, during the path E sequence, work implement 30 may be tilted when work implement 30 engages pile 20 at approximately 1.5 seconds. Tilting work implement 30 may help reduce the path E sequence loading because work implement 30 may push material upward out of pile 20 rather than forward into pile 20. The path E sequence loading may peak at approximately 3.2 seconds when machine 10 ceases moving forward. The path E sequence loading may then fall as machine 10 moves rearward while work implement 30 is lifted and/or tilted out of pile 20 (between approximately 3.2-5.6 seconds).

Although the peak path E sequence loading may be substantially equivalent to the peak path O sequence loading, it should be noted that the energy expended during the path E sequence may be less than the energy expended during the path O sequence. This is because, during the path E sequence, work implement 30 may push material upward out of pile 20 rather than forward into pile 20, reducing the average path E sequence loading such that it is less than the average path O sequence loading.

Figure 6:
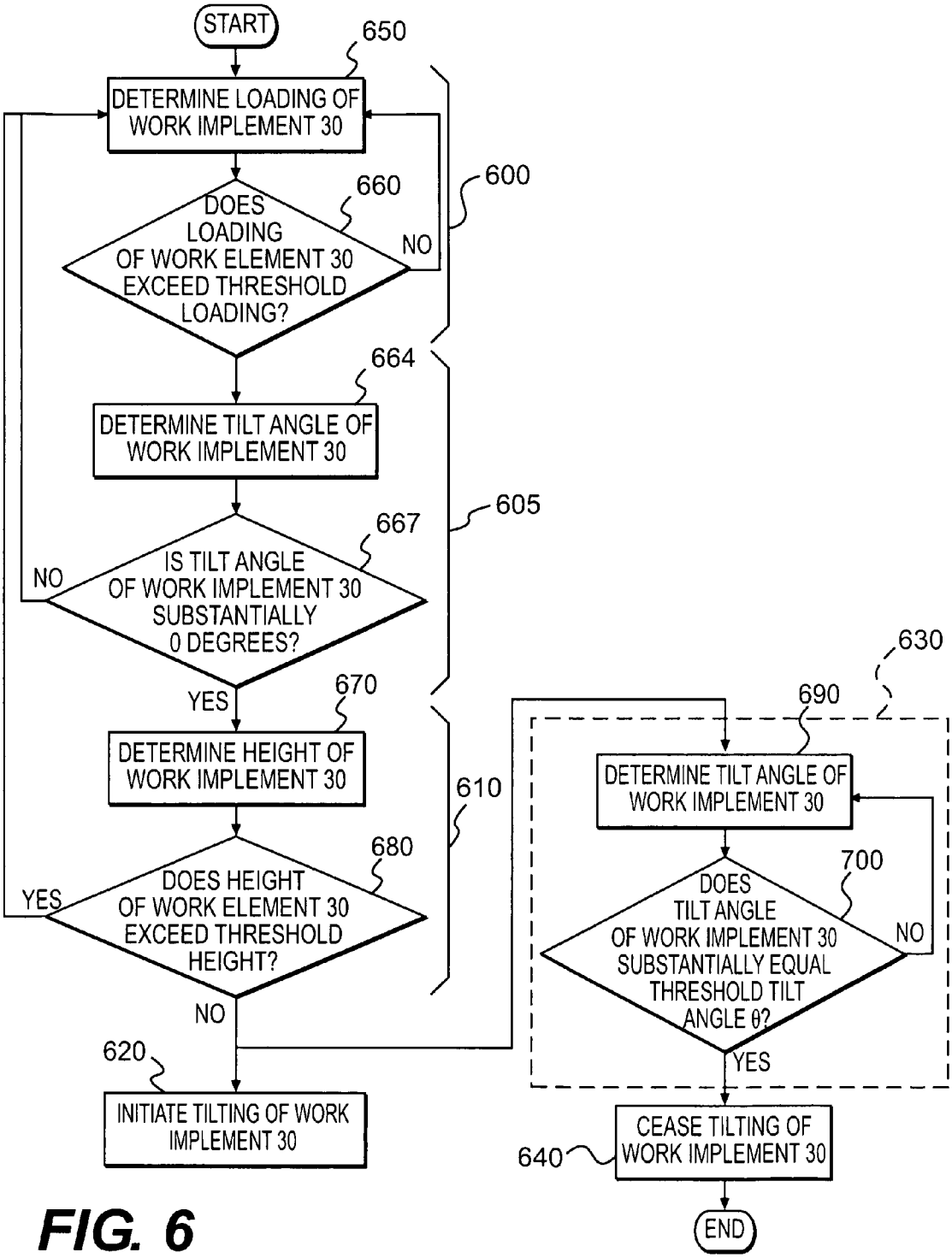
FIG. 6 is a flow chart describing an exemplary method of operating the digging control system of FIG. 2.

FIG. 6 illustrates an exemplary method of operating digging control system 70 to dig. FIG. 6 will be discussed in the following section to further illustrate digging control system 70 and its operation.

INDUSTRIAL APPLICABILITY

The disclosed system may be applicable to earthmoving machines. The system may control movements of work implements of the earthmoving machines. In particular, the system may control tilting and/or lifting of the work implements based on loadings of the work implements. Operation of the system will now be described.

As illustrated in FIG. 6, digging control system 70 (referring to FIG. 2), and more specifically, controller 80, may monitor the loading of work implement 30 (referring to FIG. 1) as work implement 30 moves toward pile 20 (step 600). This movement of work implement 30 toward pile 20 may be achieved via movement of machine 10. Specifically, an operator of machine 10 or an autonomous control system of machine 10 may initiate movement of machine 10 toward pile 20 by, for example, power source 25 and traction devices 23 of machine 10. Additionally, controller 80 may monitor the tilt angle of work implement 30 as work implement 30 moves toward pile 20 (step 605). Controller 80 may also monitor the height of work implement 30 as work implement 30 moves toward pile 20 (step 610). Based on the monitored loading, tilt angle, and/or height of work implement 30, controller 80 may initiate tilting of work implement 30 when work implement 30 engages pile 20 (step 620). Alternatively, the operator may monitor the loading, tilt angle, and/or height of work implement 30, and initiate tilting of work implement 30 when work implement 30 engages pile 20. Controller 80 may also monitor the tilt angle of work implement 30 as work implement 30 tilts (step 630). Based on this monitored tilt angle, controller 80 may cease tilting of work implement 30 when the tilt angle substantially equals threshold tilt angle θ (step 640). Alternatively, the operator may monitor the tilt angle of work implement 30 with respect to longitudinal plane P and cease tilting of work implement 30 when the tilt angle substantially equals threshold tilt angle θ. When the tilting of work implement 30 ceases, work implement 30 may be tilted and/or lifted out of pile 20 as work implement 30 is moved away from pile 20. This movement of work implement 30 away from pile 20 may be achieved via movement of machine 10. Specifically, the operator or autonomous control system of machine 10 may initiate movement of machine 10 away from pile 20.

The monitoring of step 600 may include sub-steps. In particular, step 600 may include the sub-step of determining the loading of work implement 30 (sub-step 650). Specifically, controller 80 may receive from torque sensor 92, pressure sensor 94, ground speed sensor 96, and/or speed sensor 98 of sensing system 90 one or more signals indicative of the loading of work implement 30. For example, controller 80 may receive a signal from torque sensor 92 indicative of the torque of power source 25; a signal from pressure sensor 94 indicative of the pressure within tilt actuator 50 and/or lift actuator 60; a signal from ground speed sensor 96 indicative of the ground speed of machine 10; and/or a signal from speed sensor 98 indicative of the speed of power source 25. Controller 80 may then calculate the loading of work implement 30 based on these signals. For example, the loading of work implement 30 may be related to the torque of power source 25; the speed of power source 25; the pressure within tilt actuator 50 and/or lift actuator 60; and/or the ground speed of machine 10. Step 600 may also include the sub-step of comparing the loading of work implement 30 to a threshold loading (sub-step 660). This threshold loading may correspond to the loading of work implement 30 when work implement 30 engages pile 20. The threshold loading may vary based on the form of material included by pile 20. The threshold loading may also vary based on the configuration of machine 10. If the loading of work implement 30 exceeds the threshold loading (i.e., work implement 30 engages pile 20), controller 80 may proceed to step 605 and monitor the tilt angle of work implement 30. Alternatively, controller 80 may proceed to step 610 and monitor the height of work implement 30. In yet another alternative, controller 80 may proceed to step 620 and initiate tilting of work implement 30. Otherwise, controller 80 may repeat step 600.

The monitoring of step 605 may also include sub-steps. In particular, step 605 may include the sub-step of determining the tilt angle of work implement 30 (sub-step 664). Specifically, controller 80 may receive from tilt sensor 110 a signal indicative of the tilt angle of work implement 30. Controller 80 may then calculate the tilt angle of work implement 30 based on this signal. This calculation may include a comparison between the tilt angle of work implement 30 and longitudinal plane P. Step 605 may also include the sub-step of comparing the tilt angle of work implement 30 to 0 degrees (sub-step 667). The tilt angle of work implement 30 may be substantially 0 degrees when work implement 30 engages pile 20. Tilt angles differing from substantially 0 degrees may indicate that work implement 30 has not engaged pile 20 (i.e., the loading of work implement 30 may exceed the threshold loading for reasons unrelated to engagement of pile 20 by work implement 30). If the tilt angle of work implement 30 is substantially 0 degrees, controller 80 may proceed to step 610 and monitor the height of work implement 30. Alternatively, controller 80 may proceed to step 620 and initiate tilting of work implement 30. Otherwise, controller 80 may proceed to step 600 and again monitor the loading of work implement 30.

The monitoring of step 610 may also include sub-steps. In particular, step 610 may include the sub-step of determining the height of work implement 30 (sub-step 670). Specifically, controller 80 may receive from height sensor 100 a signal indicative of the height of work implement 30. Controller 80 may then calculate the height of work implement 30 based on this signal. Step 610 may also include the sub-step of comparing the height of work implement 30 to a threshold height (sub-step 680). The height of work implement 30 may be below or equal to the threshold height when work implement 30 engages pile 20. Heights exceeding the threshold height may indicate that work implement 30 has not engaged pile 20 (i.e., the loading of work implement 30 may exceed the threshold loading for reasons unrelated to engagement of pile 20 by work implement 30). The threshold height may vary based on the form of material included by pile 20. The threshold loading may also vary based on the configuration of machine 10. If the height of work implement 30 exceeds the threshold height, controller 80 may proceed to step 600 and again monitor the loading of work implement 30. Otherwise, controller 80 may proceed to step 620 and initiate tilting of work implement 30.

At step 620, controller 80 may initiate tilting of work implement 30 when work implement 30 engages pile 20 (i.e., when the monitored loading, tilt angle, and/or height of work implement 30 indicate engagement of pile 20 by work implement 30). Specifically, controller 80 may initiate the tilting of work implement 30 via tilt actuator 50. This tilting may cause tip 120 to move upward relative to longitudinal plane P (referring to FIG. 3). During step 620, controller 80 may not initiate lifting of work implement 30 via lift actuator 60. As previously discussed, however, the tilting of work implement 30 via tilt actuator 50 may cause lifting of work implement 30. In some embodiments, controller 80 may inhibit this lifting of work implement 30 via lift actuator 60. Specifically, controller 80 may compensate via lift actuator 60 for any lifting of work implement 30 caused by tilt actuator 50.

As previously discussed, controller 80 may monitor the tilt angle of work implement 30 during step 620 (step 630). This monitoring may include sub-steps. In particular, step 630 may include the sub-step of determining the tilt angle of work implement 30 (sub-step 690). Specifically, controller 80 may receive from tilt sensor 10 a signal indicative of the tilt angle of work implement 30. Controller 80 may then calculate the tilt angle of work implement 30 based on this signal. This calculation may include a comparison between the tilt angle of work implement 30 and longitudinal plane P. Step 620 may also include the sub-step of comparing the tilt angle of work implement 30 to the threshold tilt angle θ (sub-step 700). When the tilt angle of work implement 30 substantially equals threshold tilt angle θ, controller 80 may proceed to step 640 and cease the tilting of work implement 30. Otherwise, controller 80 may repeat step 630.

It is contemplated that tilting work implement 30 when work implement 30 engages pile 20 may help minimize the energy expended by machine 10 in lifting and tilting work implement 30 to dig pile 20. Specifically, the tilting of work implement 30 when work implement 30 engages pile 20 may, as previously discussed, reduce the horizontal loading of work implement 30. Instead of needlessly pushing material forward into pile 20, work implement 30 may instead push material upward out of pile 20. The reduction in the horizontal loading of work implement 30 may reduce the average loading of work implement 30 during the lifting and tilting of work implement 30, thereby reducing the energy expended by machine 10 during the lifting and tilting of work implement 30.

It is further contemplated that operators of machines 10 may be able to, without controller 80, help minimize the total energy expended by machine 10 in lifting and tilting work implement 30 to dig pile 20. This is because the operators may be able to minimize the total energy expended by machine 10 without simultaneously initiating tilting and lifting of work implement 30. Instead, the operators may first initiate tilting of work implement 30 to avoid needlessly pushing material forward into pile 20, and then later initiate lifting of work implement 30 to lift material out of pile 20.

It will be apparent to those skilled in the art that various modifications and variations can be made to the method and system of the present disclosure. Other embodiments of the method and system will be apparent to those skilled in the art from consideration of the specification and practice of the method and system disclosed herein. It is intended that the specification and examples be considered as exemplary only, with a true scope of the disclosure being indicated by the following claims and their equivalents.

What is claimed is:

1. A digging control system for use with a machine having a work implement, the digging control system comprising:

a sensing system associated with the machine and configured to generate a signal indicative of a loading of the work implement; and a controller in communication with the sensing system and the work implement, the controller being configured to:

determine the loading of the work implement based on the signal;

during commencement of a digging process, initiate tilting of the work implement prior to lifting the work implement in response to a determination that the loading of the work implement exceeds a threshold loading;

monitor a tilt angle of the work implement; and cease tilting of the work implement when the tilt angle of the work implement substantially equals a threshold tilt angle.

2. The digging control system of claim 1, wherein the sensing system includes at least one of:

a torque sensor associated with a power source of the machine and configured to generate a signal indicative of a torque of the power source;

a pressure sensor associated with a hydraulic cylinder connected to the work implement, the pressure sensor being configured to generate a signal indicative of a pressure within the hydraulic cylinder;

a ground speed sensor associated with the machine and configured to generate a signal indicative of a ground speed of the machine; or a speed sensor associated with the power source and configured to generate a signal indicative of a speed of the power source.

3. The digging control system of claim 1, further including a height sensor associated with the work implement and configured to generate a height signal indicative of a height of the work implement, wherein:

the controller is in communication with the height sensor;

the controller is further configured to determine the height of the work implement based on the height signal; and the controller is configured to initiate tilting of the work implement only when both the determined loading of the work implement exceeds the threshold loading and the determined height of the work implement is below or equal to a threshold height.

4. The digging control system of claim 1, further including a tilt sensor associated with the work implement and configured to generate a tilt signal indicative of the tilt angle of the work implement, wherein the controller is in communication with the tilt sensor and is further configured to:

determine the tilt angle of the work implement based on the tilt signal; and compare the tilt angle of the work implement to a longitudinal plane of the machine.

5. The digging control system of claim 4, wherein the controller is configured to initiate tilting of the work implement only when both the determined loading of the work implement exceeds the threshold loading and the tilt angle of the work implement is substantially 0 degrees.

6. The digging control system of claim 4, wherein the threshold tilt angle is less than a maximum tilt angle of the work implement.

7. The digging control system of claim 6, wherein the threshold tilt angle is between substantially 10-20 degrees.

8. The digging control system of claim 1, wherein the controller is further configured to initiate lifting of the work implement when the tilting of the work implement is ceased.

9. The digging control system of claim 1, wherein the controller is further configured to inhibit lifting of the work implement during the tilting of the work implement.

10. A method of digging with a work implement of a machine, the method comprising:

monitoring a loading of the work implement;

when the work implement engages a pile of material, tilting the work implement prior to lifting the work implement when the loading of the work implement exceeds a threshold loading;

monitoring a tilt angle of the work implement; and ceasing tilting of the work implement when the tilt angle of the work implement substantially equals a threshold tilt angle.

11. The method of claim 10, wherein:

monitoring the loading of the work implement includes monitoring when the work implement engages the pile of material; and the loading of the work implement exceeds the threshold loading when the work implement has engaged the pile of material.

12. The method of claim 10, wherein monitoring the loading of the work implement includes at least one of:

sensing a power source torque of the machine;

sensing a pressure within a hydraulic cylinder associated with the work implement;

sensing a ground speed of the machine; or sensing a power source speed of the machine.

13. The method of claim 10, further including monitoring a height of the work implement, wherein tilting the work implement occurs only when both the loading of the work implement exceeds the threshold loading and the height of the work implement is below or equal to a threshold height.

14. The method of claim 10, wherein monitoring the tilt angle of the work implement includes monitoring the tilt angle of the work implement with respect to a longitudinal plane of the machine.

15. The method of claim 14, wherein tilting the work implement occurs only when both the loading of the work implement exceeds the threshold loading and the tilt angle of the work implement is substantially 0 degrees.

16. The method of claim 14, wherein the threshold tilt angle is less than a maximum tilt angle of the work implement.

17. The method of claim 16, wherein the threshold tilt angle is between substantially 10-20 degrees.

18. The method of claim 10, further including inhibiting lifting of the work implement during the tilting of the work implement.

19. A machine, comprising:

a power source;

a work implement;

a linkage having an actuator associated with the work implement to tilt the work implement;

a frame operatively connecting the power source, the work implement, and the linkage; and a digging control system, including:

a sensing system associated with the machine and configured to generate a signal indicative of a loading of the work implement; and a controller in communication with the sensing system and the actuator, the controller being configured to:

determine the loading of the work implement based on the signal;

during commencement of a digging process, initiate tilting of the work implement via the actuator prior to lifting the work implement in response to a determination that the loading of the work implement exceeds a threshold loading;

monitor a tilt angle of the work implement; and cease tilting of the work implement via the actuator when the tilt angle of the work implement substantially equals a threshold tilt angle.

20. The machine of claim 19, wherein the linkage is a torque parallel linkage.

* * * * *